US009647362B2

(12) United States Patent
Tatzel

(10) Patent No.: US 9,647,362 B2
(45) Date of Patent: May 9, 2017

(54) THERMALLY SENSITIVE CONTACT LUG

(71) Applicant: Rosenberger Hochfrequenztechnik GmbH & Co. KG, Fridolfing (DE)

(72) Inventor: Frank Tatzel, Ostermiething (AT)

(73) Assignee: Rosenberger Hochfrequenztechnik GmbH & Co., KG, Fridolfing (DE)

( * ) Notice: Subject to any disclaimer, the term of this patent is extended or adjusted under 35 U.S.C. 154(b) by 0 days.

(21) Appl. No.: 14/648,490

(22) PCT Filed: Oct. 29, 2013

(86) PCT No.: PCT/EP2013/003256
§ 371 (c)(1),
(2) Date: May 29, 2015

(87) PCT Pub. No.: WO2014/086445
PCT Pub. Date: Jun. 12, 2014

(65) Prior Publication Data

US 2015/0303602 A1 Oct. 22, 2015

(30) Foreign Application Priority Data

Dec. 3, 2012 (DE) ..... 20 2012 011 584 U

(51) Int. Cl.

| | |
|---|---|
| ***H01R 4/00*** | (2006.01) |
| ***H01R 12/71*** | (2011.01) |
| ***H01R 4/01*** | (2006.01) |
| ***H01R 13/04*** | (2006.01) |
| ***H01R 13/11*** | (2006.01) |
| ***H01R 13/193*** | (2006.01) |

(52) U.S. Cl.
CPC ..... *H01R 12/716* (2013.01); *H01R 4/01* (2013.01); *H01R 13/04* (2013.01); *H01R 13/11* (2013.01); *H01R 13/193* (2013.01)

(58) Field of Classification Search
CPC ..... H01R 12/716; H01R 4/01; H01R 13/11; H01R 13/193
USPC ..... 439/66, 161, 851
See application file for complete search history.

(56) References Cited

U.S. PATENT DOCUMENTS 3,913,444 A * 10/1975 Otte ..... F16B 1/0014 174/DIG. 8
4,379,575 A * 4/1983 Martin ..... B23P 11/025 285/369
4,519,666 A * 5/1985 Williams ..... H01R 4/10 29/879

(Continued)

FOREIGN PATENT DOCUMENTS

EP 0053745 A1 6/1982
EP 0260132 A2 3/1988

(Continued)

*Primary Examiner* — Abdullah Riyami
*Assistant Examiner* — Nelson R Burgos-Guntin
(74) *Attorney, Agent, or Firm* — DeLio, Peterson & Curcio, LLC; Robert Curcio

(57) ABSTRACT

A contact lug for electrically conductively connecting at least two components, wherein the contact lug is designed to apply a contact pressure to at least one of the components, the contact pressure being exerted by elastic deformation of the contact lug, wherein the contact lug is at least partially formed from a bimetal in such a way that an increase in the temperature of this bimetal leads to an increase in the contact pressure.

5 Claims, 2 Drawing Sheets

(56) References Cited

U.S. PATENT DOCUMENTS

| | | | | |
|---|---|---|---|---|
| 4,810,201 | A * | 3/1989 | de Mendez | H01R 4/01 439/161 |
| 5,217,382 | A | 6/1993 | Sparks | |
| 5,301,213 | A * | 4/1994 | Linden | G21C 19/00 285/381.2 |
| 5,420,392 | A * | 5/1995 | Sakata | G03G 15/2053 219/216 |
| 5,445,532 | A | 8/1995 | Evans | |
| 9,209,580 | B2 * | 12/2015 | Rosenberger | H01R 13/622 |
| 9,281,598 | B2 * | 3/2016 | Zebhauser | H01R 13/111 |
| 2002/0013103 | A1 * | 1/2002 | Kamei | B29C 61/0625 439/730 |
| 2002/0102868 | A1 * | 8/2002 | Li | H01R 13/2407 439/66 |
| 2004/0241538 | A1 | 12/2004 | Hayashida | |
| 2015/0303602 | A1 * | 10/2015 | Tatzel | H01R 4/01 439/66 |

FOREIGN PATENT DOCUMENTS

| | | | |
|---|---|---|---|
| FR | 2443755 | A1 | 7/1980 |
| FR | 2809539 | A1 | 11/2001 |
| JP | H04121980 | A | 4/1992 |
| JP | 2000315555 | A | 11/2000 |
| JP | 363217647 | A | 9/2008 |
| WO | 2007006601 | A1 | 1/2007 |

* cited by examiner

THERMALLY SENSITIVE CONTACT LUG

BACKGROUND OF THE INVENTION

1. Field of the Invention

The invention relates to a contact lug for the electrically conductive connection of at least two components, wherein the contact lug is designed to apply a contact pressure to at least one of the components, said contact pressure being exerted by elastic deformation of the contact lug. The invention also relates to a system with one or more such contact lugs, in particular, are designed as a plug connector system.

2. Description of Related Art

In many technical systems it is necessary to transmit a large number of electrical currents. The currents can either represent signals for the communication of information (for example: measured values, analogue or digital), or can serve as supply energy.

Such technical systems are generally of modular construction, whereby the signals or the electrical supply energy is transmitted from one module to the other module. In order to guarantee that the system functions perfectly, this transmission must take place with as little loss as possible.

Previously, systems have been widely used in which the transmission from one module to the next takes place by means of conventional plug connectors. One module is thereby equipped with a plug-formed plug connector and the other module is equipped with a coupler-formed plug connector of one or more or compatible plug connector series (for example SMA, RPC-2.92, SMP, but also other standardized and non-standardized plug-socket connections). Due to the dimensions of the plug connectors, these systems require a lot of construction space, which is not always available. Also, they are not user-friendly for greater numbers of channels because the plug connectors are in most cases coupled by means of screw connections.

Systems are also known in which the transmission is realized by means of one or more contact lugs designed as leaf springs which press against a fixed mating part. These systems permit a higher packing density; however, most exert a relatively low contact pressure. Nonetheless, due to the high number of contacts, in total a considerable plugging force is reached when coupling, which can for example lead to considerable problems during blind plugging of a circuit board.

In order to be able to transmit high supply currents, the contact resistance at the contact points must be kept as low as possible. A decisive factor for the level of the contact resistance is the contact force applied at the contact point. If this is too low, the contact resistance is very high, which leads to an undesired thermal loading of the contact point. In the known systems an attempt is made to avoid this, in that the contact lugs exert the highest possible spring force. It is thereby immaterial whether the contact lugs are deflected radially (plug-socket contact) or axially (as leaf springs). However, this high spring tension also leads to a correspondingly greater plugging force during the coupling process which can in particular be disadvantageous in cases where several connections are to be plugged together in parallel and is by no means user-friendly.

In the case of signal transmission, due to the lower currents involved the main issue is not the thermal loading on the contact points (though this can also be a problem in this case), but the quality of the transmitted signal. Here too, in addition to a wide variety of other measures, an attempt is made to keep the losses at the contact points as low as possible by ensuring the greatest possible contact forces. Since, particularly in the case of systems used for signal transmission, the number of signal paths is very high and the construction space available can be very limited, several problems can arise at once: on the one hand, the contact force for the individual channels should be kept as low as possible in order to keep the total plugging force required within limits. On the other hand, due to the limited space available, the freedom of design in terms of an optimized spring geometry can be very limited. These problems are also exacerbated in that in these signal transmission systems in particular a great number of accurately repeatable plugging cycles is necessary.

SUMMARY OF THE INVENTION

Starting out from this state of the art, the invention was based on the problem of providing a plug connection which is distinguished through low plugging forces combined with good transmission properties.

This problem is solved by a system according to the claims, which include one or more contact lugs. Further advantageous embodiments of the system according to the invention and of the contact lug(s) used therein are the subject matter of the claims and are explained in the following description of the invention.

The above and other objects, which will be apparent to those skilled in the art, are achieved in the present invention which is directed to a contact lug for the electrically conductive connection of at least two components, wherein the contact lug applies a contact pressure to at least one of the components, the contact pressure being exerted by elastic deformation of the contact lug, wherein the contact lug includes a bimetal construction, such that an increase in the temperature of the bimetal leads to an increase in the contact pressure, wherein the contact lug includes a first contact region for making contact with a first component and a second contact region for making contact with a second component as well as extending in a curved or angled line between the contact regions, so that a deformation of the contact lug is associated with a moving together of the two contact regions. The components may be circuit boards.

In a second embodiment, the present invention is directed to a system with a contact lug for the electrically conductive connection of at least two components, wherein the contact lug applies a contact pressure to at least one of the components, the contact pressure being exerted by elastic deformation of the contact lug, wherein the contact lug includes a bimetal construction, such that an increase in the temperature of the bimetal leads to an increase in the contact pressure, wherein the contact lug includes a first contact region for making contact with a first component and a second contact region for making contact with a second component as well as extending in a curved or angled line between the contact regions, so that a deformation of the contact lug is associated with a moving together of the two contact regions and at least two components in the form of circuit boards which are to be connected electrically by the contact lug.

The system may further include a controller for controlling the temperature of the contact lug.

In the system, the contact lug may not make contact when positioning the components.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
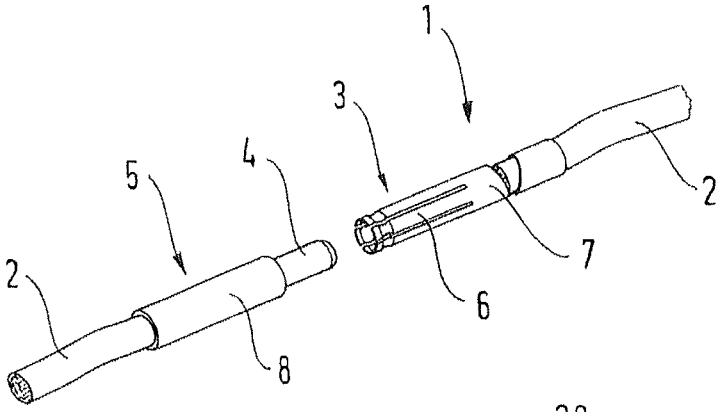
FIG. 1 shows a perspective view of a first embodiment of a system according to the invention in its unplugged state.

In describing the preferred embodiment of the present invention, reference will be made herein to FIGS. 1-9 of the drawings in which like numerals refer to like features of the invention.

The invention is based on the idea of making use of the particular thermal deformation behavior of bimetals so that only low total plugging forces are required during the plugging-together of a plug connection in that no deformation or only slight deformation of the contact lugs of the plug connection takes place, and the contact pressure at the contact points which the contact lugs form with the components, which are to be connected electrically (and which is necessary for good transmission properties), is achieved through heating of the bimetal following the plugging-together of the components. The low plugging force required not only improves handling, the wear caused when plugging together or making contact is also reduced, which allows the service life of the components to be extended.

Accordingly, a contact lug of the generic type for the electrically conductive connection of at least two components, whereby the contact lug is designed to apply a contact pressure to at least one of the components, the pressure being exerted through an elastic deformation of the contact lug, is characterized in that the contact lug is, at least in part, formed of a bimetal, such that an increase in the temperature of the bimetal leads to an increase in the contact pressure.

A corresponding system according to the invention comprises (at least) one contact lug according to the invention and at least two components which are to be connected electrically by means of the contact lug.

According to the invention, the term "bimetal" is understood to refer to a preferably electrically conductive, elastically deformable component with at least two layers consisting of materials with different coefficients of thermal expansion. Preferably, these materials are metals, which regularly display both advantageous elastic and electrically conductive properties.

Preferably, it can be the case that the system according to the invention comprises a plug connection with at least two plug connectors or is designed as such, whereby the at least one contact lug is also preferably part of one of the plug connectors. This allows the plug connection to be plugged together with low plugging force, whereby, nonetheless, after heating the bimetal of the contact lug(s) a sufficiently great contact pressure can be realized at the contact points between the contact lugs and the at least two components.

It can also be the case that the contact lug forms at least a part of a socket of one of the plug connectors which is designed to receive a pin-formed section of another of the plug connectors. In this case the elastic deformation of the contact lug can take place in a radial direction. A contact pressure is then so to speak applied by the contact lug in a radial direction against a jacket of the pin-formed part of the other plug connector. Particularly preferably, the socket can be formed by a plurality of contact lugs according to the invention disposed in a ring-formed arrangement.

In another embodiment of the contact lug, this can have a first contact region (for making contact with a first component) and a second contact region (for making contact with a second component) as well as extending in a curved or angled line between the contact regions. In this case a deformation can be associated with a moving-together of the two contact regions. Such a contact lug is suitable in particular for the electrically conductive connection of contact points of the components which are to be connected, which are arranged opposite one another, as is frequently the case with the electrically conductive connection of two or more circuit boards.

In a preferred embodiment of the system according to the invention it can be the case that the contact lug is already deformed elastically when plugging together the plug connection, whereby this elastic deformation can be selected to be as small as possible. This ensures that after the plug connection is plugged together, and even without heating the bimetal of the contact lug, an electrically conductive connection between the components is established. However, as a result of the comparatively low contact pressure this can be associated with a relatively high contact resistance in the contact point(s). This relatively high contact resistance can, at least with the transmission of relatively high currents, lead to heating of the contact lug, which then leads to the increase in the contact pressure through the specific deformation of the bimetal provided for according to the invention. The increased contact pressure then leads to a reduction in the electrical dissipation loss and thus the further generation of heat until an equilibrium, dependent on the strength of the current and the dissipation of heat from the system, which can also be influenced in a controlled way, is established. Such an embodiment of the system according to the invention is suitable in particular for the transmission of electrical supply energy, since this regularly involves relatively high current levels.

Figure 2:
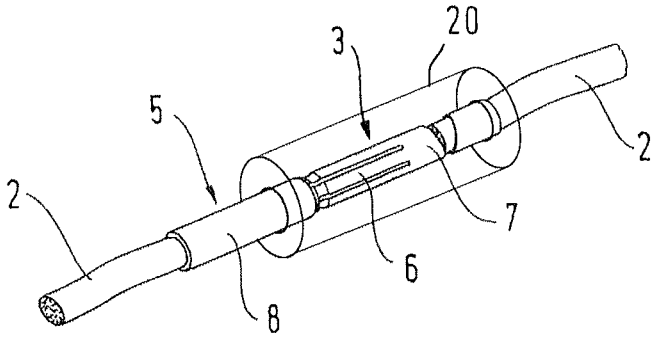
FIG. 2 shows the system according to FIG. 1 its plugged-together state.

However, in order to influence the dissipation of heat, even with an active input of heat, for the purpose of deformation of the contact lug, the system according to the invention possesses a controller for controlling the temperature (of the bimetal) of the contact lugs. These should be understood to include controlled influencing of the temperature of the contact lug. In the broader sense the controller 20 can also be understood to comprise a housing, as depicted in FIG. 2, surrounding an electrical installation comprising at least one system according to the invention which, in operation, generates waste heat which is only conducted away through the housing in a delayed and preferably controlled manner (for example through corresponding actuation of cooling fans).

Insofar as such means for controlling temperature are provided, it can also be the case that, when plugging together the plug connection or when positioning the components, the contact lug does not yet make contact with a mating contact element. This allows a largely force-free plugging or positioning, whereby the contact pressure is exclusively generated through the later deformation of the contact lug resulting from heating. A controlled cooling of the contact lug can also be achieved through the means for controlling temperature, as a result of which the contact pressure is reduced again. This can in particular be relevant when it comes to disconnecting the electrically conductive connection between the two components.

FIGS. 1 to 4 show a first embodiment of a plug connection system according to the invention.

This comprises a first plug connector 1 which is connected, electrically conductively, at a cable-side end, in a known manner, with a cable 2. The first plug connector 1 is designed as a coupler and for this purpose comprises a socket-formed seating region 3, into which a pin-formed contact element 4 of a second plug connector 5 of the plug connector system can be plugged. The socket-formed seating region 3 is formed by several contact lugs 6 disposed in a ring-formed arrangement, which according to the invention are at least partially formed of a bimetal. In this exemplary embodiment, both the contact lugs 6 and a base body 7 of the first plug connector 1, into which these merge integrally, are formed of a bimetal. For this purpose, the first plug connector 1 can preferably be designed as a stamped and bent component.

The second plug connector 5, designed in solid form in this exemplary embodiment, also comprises, in addition to the pin-formed contact element 4, a base body 8 formed integrally with this. The base body 8 of the second plug connector 5 is connected, electrically conductively, at a cable-side end, in a known manner, with a cable 2.

Figure 3:
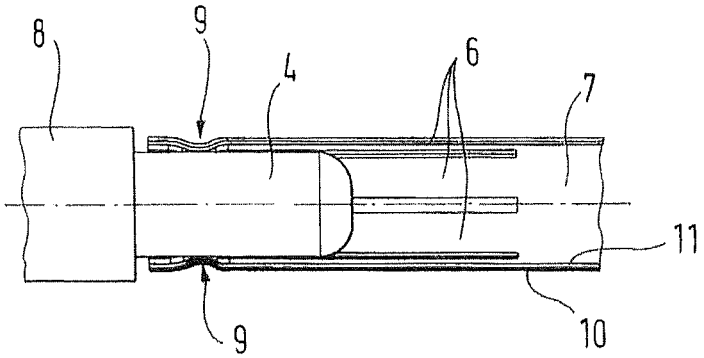
FIG. 3 shows a partial longitudinal section through a part of the system according to FIG. 2.
Figure 4:
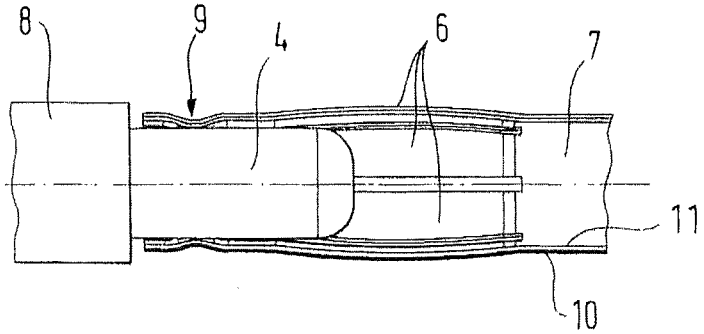
FIG. 4 shows the system according to FIG. 3 following heating of the contact lugs.
Figure 5:
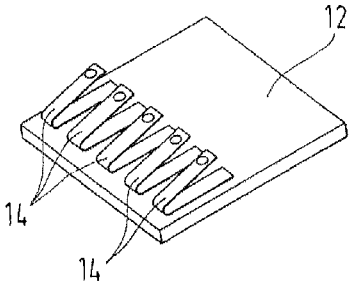
FIG. 5 shows a perspective view of a component with several contact lugs of a second embodiment of a system according to the invention fixed to it.
Figure 6:
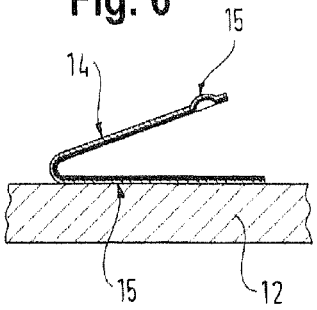
FIG. 6 shows a cross section through the component and a contact lug of the system according to FIG. 5.

FIG. 1 shows the plug connection system in its unplugged state, whereas the plugged-together state is shown in FIGS. 2 to 4. FIG. 3 shows the state directly after the plug connection system is plugged together. In this state, the curved, inwards-facing contact regions 9 of the contact lugs 6 already make contact with the outside of the pin-formed contact element 4 of the second plug connector 5, but are not yet elastically deformed to any relevant extent. This allows the connectors to be plugged together with only low plugging forces. However, at the same time a transmission of current via the plug connection system is already possible, whereby, as a result of the low contact pressure at the contact points, this is impeded by a relatively high contact resistance, which leads to electrical dissipation loss and thus to a heating of the plug connection system, in particular in the region of the contact points 9.

This heating leads to a deformation of the contact lugs 6 as a result of a different thermal expansion of the two layers 10, 11 of the bimetal of which the first plug connector 1 is formed. Since the material of the outer layer 10 has a higher coefficient of thermal expansion (in particular coefficient of linear expansion) than the material of the inner layer 11, the thermal deformation of the contact lugs 6 leads to a movement of the contact regions 9 directed radially inwards. However, this movement is prevented by the contact regions 9 making contact with the pin-formed contact element 4. As a consequence, the contact pressure at the contact points is increased through the different coefficients of thermal expansion of the bimetal. The increased reaction forces and the unequal tensions in the two layers 10, 11 can also at the same time cause the contact lugs 6 to bulge out, as shown in FIG. 4.

FIGS. 5 to 9 show a second embodiment of a system according to the invention. This comprises two components, which can in particular be two circuit boards 12, 13. These are connected in an electrically conductive manner via a plurality of contact lugs 14 according to the invention.

The contact lugs 14, designed in the form of leaf springs, comprise two flat sections which are connected via a curved section. In each case a first flat section forms on its outer side a contact region 15 via which the associated contact lug is permanently connected (for example soldered) to a contact point of a first circuit board 12. An outwards-facing convexity is provided in the vicinity of the free end of the second flat section, the surface of which serves as a contact region 15 for making contact with an associated contact point on the second circuit board 13.

According to the invention the contact lugs 14 are formed of a two-layered bimetal, whereby the layer with the greater coefficient of thermal expansion is in each case arranged on the side which does not form the contact regions 15.

Figure 7:
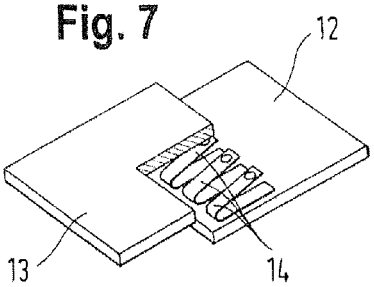
FIG. 7 shows the system according to FIG. 5 with a second component.
Figure 8A:
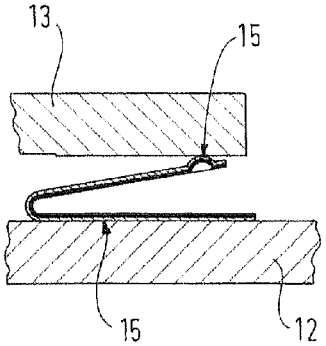
FIGS. 8*a* and 8*b* depict a cross section through the system according to FIG. 7, where the upper contact is in physical contact with a printed circuit board (FIG. 8*a*), and where the upper contact is not yet in physical contact with a printed circuit board (FIG. 8*b*)
Figure 8B:
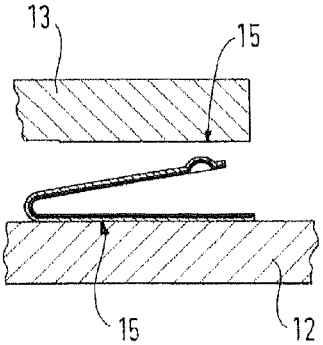
Figure 9:
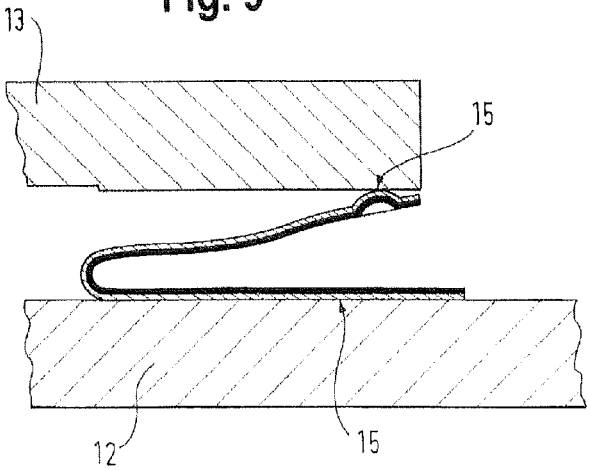
FIG. 9 shows the system according to FIG. 8 following heating of the contact lugs.

For the purpose of electrically conductive connection, the two circuit boards 12, 13 are positioned, by means of any suitable device, not shown, at a defined distance from each other, as shown in FIGS. 7 and 8. In the present exemplary embodiment, the distance between these is so small that an elastic deformation of the contact lugs 14 arranged between the circuit boards 12, 13 occurs (see FIGS. 6 and 8). FIGS. 8*a* and 8*b* depict a cross section through the system according to FIG. 7, where the upper contact is in physical contact with a printed circuit board (FIG. 8*a*), and where the upper contact is not yet in physical contact with a printed circuit board (FIG. 8*b*). Directly after the two circuit boards 12, 13 are positioned in relation to each other, these are thus already connected in an electrically conductive manner. However, the elastic deformation of the contact lugs 14 is thereby relatively slight. As a result, the pressure generated by the contact lugs 14 on positioning of the circuit boards 12, 13 is relatively small. This is, in particular, advantageous if the circuit boards 12, 13 are connected, not by means of the five contact lugs 14 shown here, purely by way of example, but by means of up to several hundred contact lugs 14, as can for example be the case in known semiconductor testing devices. However, a low contact pressure at the contact points can lead to a poor transmission of signals and in particular high frequency signals between the circuit boards 12, 13. According to the invention, the contact pressure of the individual contact lugs 14 between the convexity on the second flat section and the associated contact points on the second circuit board 13 is therefore increased in operation through a thermal deformation of the bimetal of the individual contact lugs 14. This is shown in FIG. 9, whereby the deformation of the contact lugs 14 is substantially limited to a deflection of the second flat section, whereas, however, the contact pressure at the contact point is at the same time increased correspondingly through an unequal distribution of tension.

In this exemplary embodiment, the temperature increase by means of which the increased contact pressure is achieved is essentially achieved, not through self-heating as a result of a relatively high contact resistance, as is the case with the plug connector system shown in FIGS. 1 to 4, but through the operation of a device, for example a semiconductor test device into which the described system according to the invention is integrated. During operation of this device, a relevant quantity of waste heat is generated by the numerous electrical components of the device, which can lead to the heating. This applies in particular if the system shown is integrated in a housing of the device, so that the dissipation of heat is restricted. If necessary, the device can also include means for controlling the temperature by means of which the dissipation of the waste heat from the housing can, for example, be controlled. This can allow a largely constant temperature within the housing to be achieved—possibly after a certain lag time—which is associated with a constant contact pressure at the contact points. If the two components 12, 13 are to be removed again from one another, the means for controlling the temperature can be used to achieve a controlled cooling of the contact lugs, as a result of which the contact pressure decreases again.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact lug for the electrically conductive connection comprising at least two components, wherein the contact lug applies a contact pressure to at least one of the components, said contact pressure being exerted by elastic deformation of the contact lug, wherein the contact lug includes a bimetal construction having bimetal leads, such that an increase in the temperature of the bimetal leads to an increase in the contact pressure, wherein the contact lug includes a first contact region for making contact with a first component and a second contact region for making contact with a second component as well as extending in a curved or angled line between the contact regions, so that a deformation of the contact lug is associated with a moving together of the two contact regions.

2. A system with a contact lug for an electrically conductive connection of at least two components, wherein the contact lug applies a contact pressure to at least one of the components, said contact pressure being exerted by elastic deformation of the contact lug, wherein the contact lug includes a bimetal construction having bimetal leads, such that an increase in the temperature of the bimetal leads to an increase in the contact pressure, wherein the contact lug includes a first contact region for making contact with a first component and a second contact region for making contact with a second component as well as extending in a curved or angled line between the contact regions, so that a deformation of the contact lug is associated with a moving together of the two contact regions and at least two components in the form of circuit boards which are to be connected electrically by the contact lug.

3. The system of claim 2, including a controller for controlling the temperature of the contact lug.

4. The system of claim 3, wherein the contact lug does not yet make contact when positioning the components.

5. The contact lug of claim 1 wherein said components are circuit boards.

* * * * *